US008127755B2

(12) United States Patent
Maeda

(10) Patent No.: US 8,127,755 B2
(45) Date of Patent: Mar. 6, 2012

(54) AIR GUN AND MAGAZINE FOR AIR GUN

(75) Inventor: Tetsuo Maeda, Tokyo (JP)

(73) Assignee: Maruzen Company Limited, Tokyo (JP)

( * ) Notice: Subject to any disclaimer, the term of this patent is extended or adjusted under 35 U.S.C. 154(b) by 518 days.

(21) Appl. No.: 12/285,974

(22) Filed: Oct. 17, 2008

(65) Prior Publication Data

US 2009/0235910 A1 Sep. 24, 2009

(30) Foreign Application Priority Data

Mar. 21, 2008 (JP) ..... 2008-74113

(51) Int. Cl.
*F41B 11/00* (2006.01)

(52) U.S. Cl. ..... 124/74; 124/75

(58) Field of Classification Search ..... 124/31, 124/45, 51.1, 73, 74
See application file for complete search history.

(56) References Cited

U.S. PATENT DOCUMENTS

| | | | | |
|---|---|---|---|---|
| 2006/0112944 | A1 | 6/2006 | Su | |
| 2006/0201491 | A1 * | 9/2006 | Wei | 124/74 |
| 2006/0207584 | A1 * | 9/2006 | Yeh | 124/45 |

FOREIGN PATENT DOCUMENTS

| | | | |
|---|---|---|---|
| EP | 0 932 013 | A2 | 7/1999 |
| EP | 1 939 576 | A1 | 7/2008 |

OTHER PUBLICATIONS

Extended European Search Report, App. No. EP08 01 7985, Jan. 29, 2009 (8 pages).
Taiwan IPO Search Report issued Jul. 26, 2011 for corresponding Taiwanese Application No. 097117001.
Taiwan IPO Search Report, App. No. 097117001, Date of Completion: Apr. 14, 2011 (1 page).

* cited by examiner

*Primary Examiner* — Troy Chambers
(74) *Attorney, Agent, or Firm* — Rader, Fishman & Grauer PLLC

(57) ABSTRACT

According to the present invention, by providing an extremely simple member such as a partition wall having a microscopic hole section, it is possible to reliably reduce the speed of a bullet to within a fixed speed, even a complicated decompression device such as a regulator is not provided. As a result, manufacturing time for the air gun is shortened, it is possible to lower manufacturing cost, and there is the effect of improving the manufacturing efficiency.
This is because with an air gun or a magazine for an air gun of the present invention, by having a structure where the opening area of the microscopic hole section of the partition wall is smaller that the gas discharge path opening when the gas discharge path of the discharge valve is open, the gas volume per unit time that flows into the discharge valve chamber from the gas canister side by means of the microscopic holes section is smaller than the gas volume per unit time that flow out from the discharge valve chamber as a result of opening the gas discharge path of the discharge valve, which means that gas speed and gas pressure from the discharge valve chamber to the chamber where a bullet is positioned is lowered. The firing speed of a bullet is thus reduced.

4 Claims, 21 Drawing Sheets

AIR GUN AND MAGAZINE FOR AIR GUN

BACKGROUND OF THE INVENTION

1. Field of the Invention

The present invention relates to an air gun for firing bullets with compressed air as an energy source, and also relates to an air gun for performing firing and blowback, and to a magazine for an air gun capable of being fitted into such air guns.

2. Description of the Related Art

An air gun for firing bullets using compressed air, and an air gun for carrying out both firing of bullets and blowback are known. A magazine capable of being fitted into these air guns is also known.

A normal air gun is generally constructed to fire bullets utilizing ejection pressure of a gas canister fitted to a magazine. Gas that has been discharged from a gas canister passes through a discharge valve chamber, which is a space formed between a discharge valve and piercing assembly, due to the pressure of the gas, and a bullet positioned in a chamber is fired by opening the discharge valve (refer to related art 1, FIG. 26).

Since the gas pressure discharged from the gas canister is high pressure (about 70 atmospheres), there is a problem in that if that pressure is used directly the bullet speed would be too fast. Therefore, by attaching a regulator or the like, which is a decompression device, between a piercing assembly for attaching the gas canister and the discharge valve, the gas pressure discharged from the gas canister is reduced, and the bullet speed is controlled to within a constant speed.

It is also known that with an air gun that uses a magazine with a lot of loaded bullets, the magazine is longer, and a vaporization chamber is provided inside a grip in accordance with this length (refer to related art 2, FIG. 27). In the case of related art 2 also, a decompression device such as a regulator or the like is attached directly above a piercing assembly, between a piercing assembly for attachment of the gas canister and the discharge valve.

A regulator for decompressing gas pressure from the gas canister is provided with a piston cylinder 101, as shown in related art 1 (FIG. 26) and related art 2 (FIG. 27), with a piston 100, that is provided with a piston spring 103 at an outer side and is internally provided with a gas discharge path 102, being capable of reciprocating inside this piston cylinder 101. The piston spring 103 constantly urges the piston upwards, so as to open a through passage 105 from the piercing assembly 104.

In a state with the discharge path 107 of a discharge valve closed, discharge gas from the gas canister fills up the discharge valve chamber 109 and the vaporizing chamber 110 to become a fixed high pressure, and the piston 100 is moved downwards inside the piston cylinder 101 against the urging force of the piston spring 103. Discharge gas from the gas canister is stopped as a result of a through passage closing plate 108 closing off the through passage 105 as a result of this movement, and gas pressure of the discharge valve chamber and the vaporizing chamber does not rise any further and is held at a constant pressure that is decompressed.

This decompressed gas pressure moves the discharge valve as a result of a hit pin being subjected to a trigger action, to open the gas discharge path of the discharge valve and perform firing.

In the use of current air guns, in the case where a gas canister that is for sale generally is used, when the speed of a bullet is dropped to within a speed regulated by law, it is necessary to feed gas that has been decompressed by the regulator as described above to the chamber.

However, the regulator, that is the decompression device, is constructed of a combination of various precision members such as the piston cylinder 101, which is a hollow cylinder, and the piston 100, that is provided with the piston spring 103 on an outer side and is provided with gas discharge path 102 inside, inside the piston cylinder, as shown in FIG. 26 and FIG. 27, and it is also necessary to adjust the urging force of the piston spring that is subjected to pressure from the vaporization chamber and the discharge valve chamber.

There is therefore a problem in that costs are incurred, such as processing time and procurement of components in order to provide the regulator.

SUMMARY OF THE INVENTION

In order to solve the above-described problems, there is proposed an air gun for firing bullets using compressed gas, having a piercing assembly capable of fitting a gas canister, being a compressed gas source, and a discharge valve capable of either discharging compressed gas from the gas canister to a chamber or stopping discharge of compressed gas to the chamber, wherein the discharge valve has a gas discharge path, with a discharge valve chamber formed between a partition wall, closing off the gas discharge path due to urging force of a discharge valve spring, and the discharge valve, and discharge of compressed gas is possible from the gas discharge path by opening the gas discharge path using pressing force due to a hit pin, and a partition wall having a microscopic hole section is provided between the piercing assembly and the discharge valve, and a gas volume per unit time that flows from the microscopic holes section of the partition wall into the discharge valve chamber is lower than a gas volume per unit time that flows out from the discharge valve chamber as a result of opening the gas discharge path of the discharge valve.

There is also proposed an air gun for firing bullets using compressed gas, having a piercing assembly capable of fitting a gas canister, being a compressed gas source, and a discharge valve capable of either discharging compressed gas from the gas canister to a chamber or stopping discharge of compressed gas to the chamber, wherein the discharge valve has a gas discharge path, with a discharge valve chamber formed between a partition wall, closing off the gas discharge path due to urging force of a discharge valve spring, and the discharge valve, and discharge of compressed gas is possible from the gas discharge path by opening the gas discharge path using pressing force due to a hit pin, and a partition wall having a microscopic hole section is provided between the piercing assembly and the discharge valve, and an opening area of the microscopic hole section of the partition wall is smaller than the gas discharge path opening area in a state where the gas discharge path of the discharge valve is open.

There is further proposed a magazine for an air gun capable of being fitted into an air gun for firing bullets using compressed gas, having a piercing assembly capable of fitting a gas canister, being a compressed gas source, and a discharge valve capable of either discharging compressed gas from the gas canister to a chamber or stopping discharge of compressed gas to the chamber, wherein the discharge valve has a gas discharge path, with a discharge valve chamber formed between a partition wall, closing off the gas discharge path due to urging force of a discharge valve spring, and the discharge valve, and discharge of compressed gas is possible from the gas discharge path by opening the gas discharge path using pressing force due to a hit pin, and a partition wall having a microscopic hole section is provided between the piercing assembly and the discharge valve, and a gas volume per unit time that flows from the microscopic hole section of the partition wall into the discharge valve chamber is lower than a gas volume per unit time that flows out from the discharge valve chamber as a result of opening the gas discharge path of the discharge valve.

There is still further proposed a magazine for an air gun capable of being fitted into an air gun for firing bullets using compressed gas, having a piercing assembly capable of fitting a gas canister, being a compressed gas source, and a discharge valve capable of either discharging compressed gas from the gas canister to a chamber or stopping discharge of compressed gas to the chamber, wherein the discharge valve has a gas discharge path, with a discharge valve chamber formed between a partition wall, closing off the gas discharge path due to urging force of a discharge valve spring, and the discharge valve, and discharge of compressed gas is possible from the gas discharge path by opening the gas discharge path using pressing force due to a hit pin, and the partition wall has a microscopic hole section provided between the piercing assembly and the discharge valve, and an opening area of the microscopic hole sections of the partition wall is smaller than the gas discharge path opening area in a state where the gas discharge path of the discharge valve is open.

According to the present invention, by providing an extremely simple member such as a partition wall having a microscopic hole section, it is possible to reliably reduce the speed of a bullet to within a fixed speed, even a complicated decompression device such as a regulator is not provided. As a result, manufacturing time for the air gun is shortened, it is possible to lower manufacturing cost, and there is the effect of improving the manufacturing efficiency.

This is because with an air gun or a magazine for an air gun of the present invention, by having a structure where the opening area of the microscopic hole section of the partition wall is smaller that the gas discharge path opening when the gas discharge path of the discharge valve is open, the gas volume per unit time that flows into the discharge valve chamber from the gas canister side by means of the microscopic holes section is smaller than the gas volume per unit time that flow out from the discharge valve chamber as a result of opening the gas discharge path of the discharge valve, which means that gas speed and gas pressure from the discharge valve chamber to the chamber where a bullet is positioned is lowered. The firing speed of a bullet is thus reduced.

DESCRIPTION OF THE PREFERRED EMBODIMENTS

Description will now be given based on FIG. 1 to FIG. 25 that show one embodiment of an air gun and a magazine for an air gun of this invention. The air gun shown in FIG. 1 to FIG. 24 is an air gun for firing of a bullet W using compressed air, and carrying out blowback, and has a vaporization chamber 6. Besides an air gun of this configuration, it is also possible to utilize an air gun having a vaporization chamber 6 that fires a bullet W using compressed gas but does not perform blowback, an air gun that does not have a vaporization chamber 6 and carries out blowback together with firing of a bullet W using compressed gas (FIG. 25), and an air gun that does not have a vaporization chamber 6 and fires a bullet W but does not carry out blowback.

In FIG. 1 to FIG. 25, as an embodiment of this invention, description will be given for an air gun constructed with a partition wall 1 and a discharge valve 2 etc. are provided in a magazine M, and with the magazine M capable of being fitted into an air gun body B. Description of the air gun of the drawings of the embodiment of the invention is given using an air gun provided with a fully automatic mechanism, but the same is also true for an air gun that has a semi-automatic mechanism using a sear structure. Also, as another embodiment of the invention the description is also similar for an air gun having a structure provided with a partition wall 1 and discharge valve 2 etc. in the air gun body B.

Figure 1:
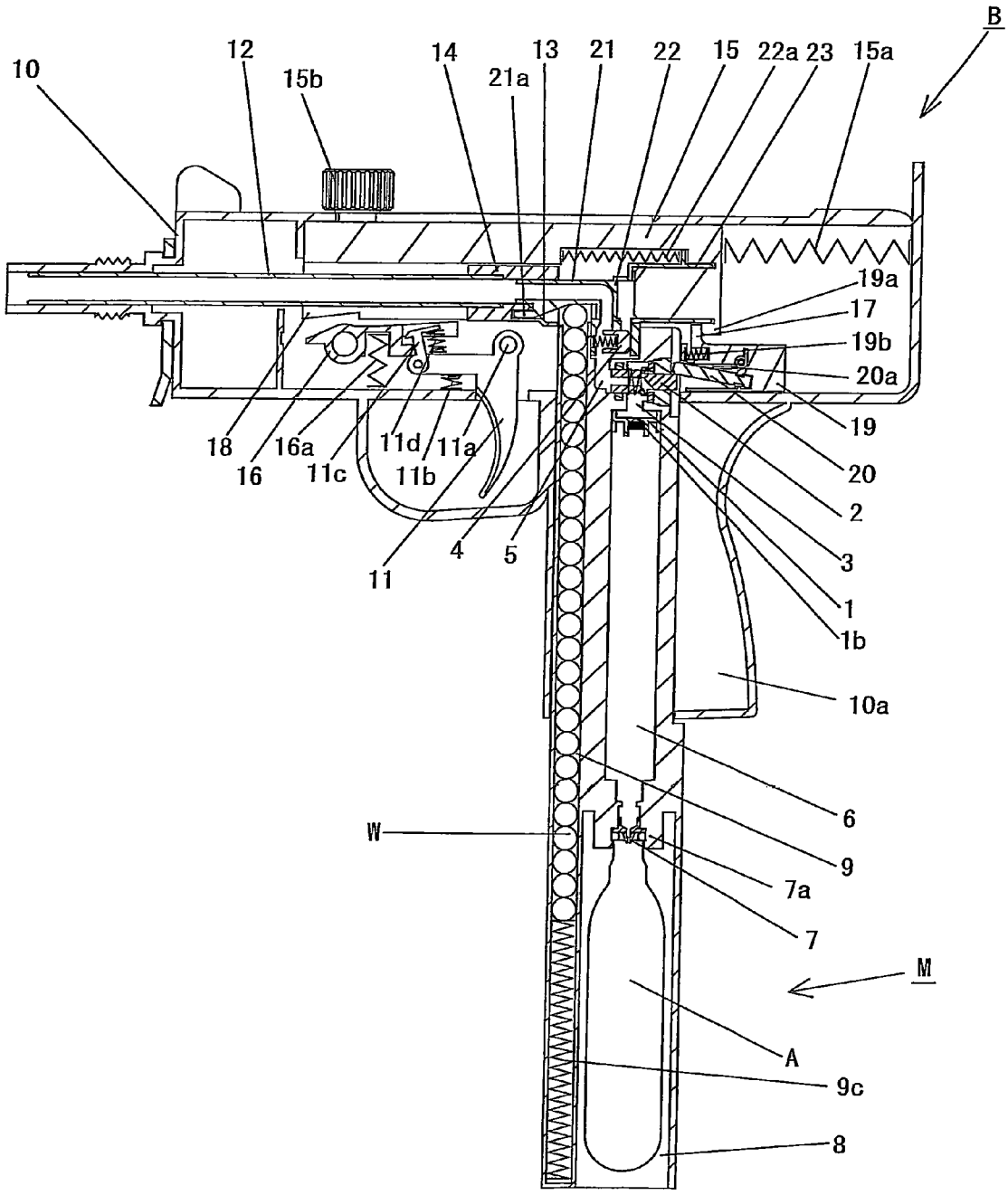
FIG. 1 shows an embodiment of the present invention, and is an internal explanatory drawing for describing the overall structure of an air gun of one embodiment.

Initially, operation of the air gun will be described based on FIG. 1 to FIG. 11. FIG. 1 is a cross sectional explanatory drawing showing the whole of an air gun. The air gun of the embodiment of the invention comprises an air gun body B having parts such as a frame 10, handle grip section 10*a*, trigger 11, inner barrel 12, feed slope 13, chamber 14, bolt 15, bolt sear 16, bolt engagement protrusion 17, sear engagement section 18, hammer 19, hit pin 20, nozzle 21, nozzle cylinder 22, and a cylinder 23, and a magazine M capable of being fitted with a gas cylinder A from a gas cylinder insertion opening 8*a* which is a lower end opening section of the handle grip section 10*a* of the air gun body B. The magazine M has parts such as a partition wall 1, discharge valve 2, discharge valve chamber 3, change valve 4, change valve chamber 5, vaporization chamber 6, piercing assembly 7, gas canister housing chamber 8 and a loading section 9. At a point in time when the gas canister 8 has been fitted into the gas canister housing chamber 8 of the magazine M, compressed gas flows from the gas canister A through the piercing assembly 7 and vaporization chamber 6, through the microscopic hole 1*b* in the partition wall 1 and into the discharge valve 3.

Figure 2:
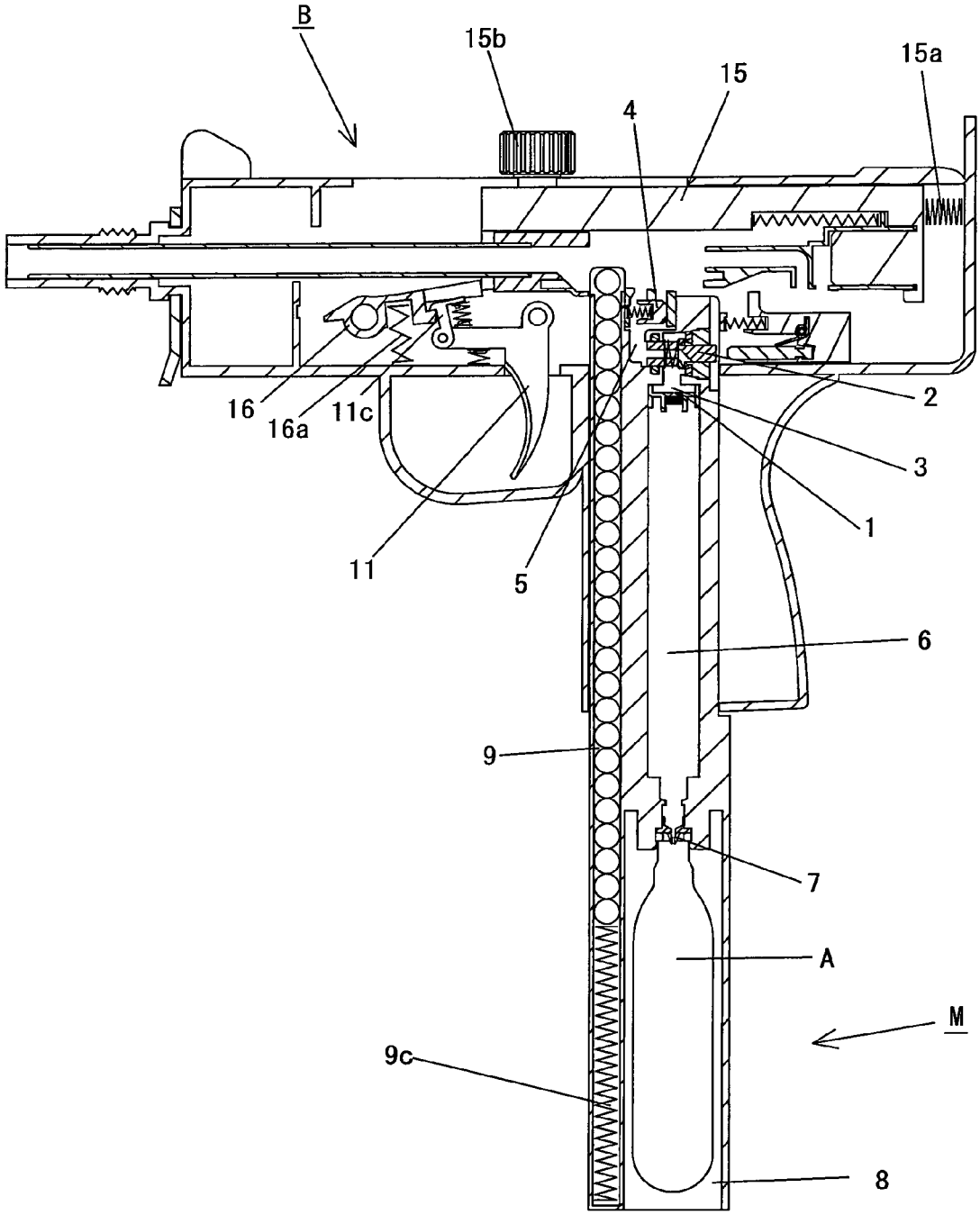
FIG. 2 shows an embodiment of the present invention, and is a cross-sectional explanatory drawing for describing an operating state of an air gun, and a magazine for an air gun, of one embodiment.

FIG. 2 is a drawing showing the state where, from the state of FIG. 1, the bolt handle 15*b* has been pulled fully to the rear of the air gun by hand. The bolt sear 16 is rotated upwards by the urging force of the bolt sear spring 16*a*, comes into contact with the trigger sear 11*c* and stops. A bolt 15 integral with the bolt handle 15*b* is urged towards the muzzle side of the air gun by a bolt return spring 15*a*, but the front end comes into contact with the bolt sear 16 and stops.

Figure 3:
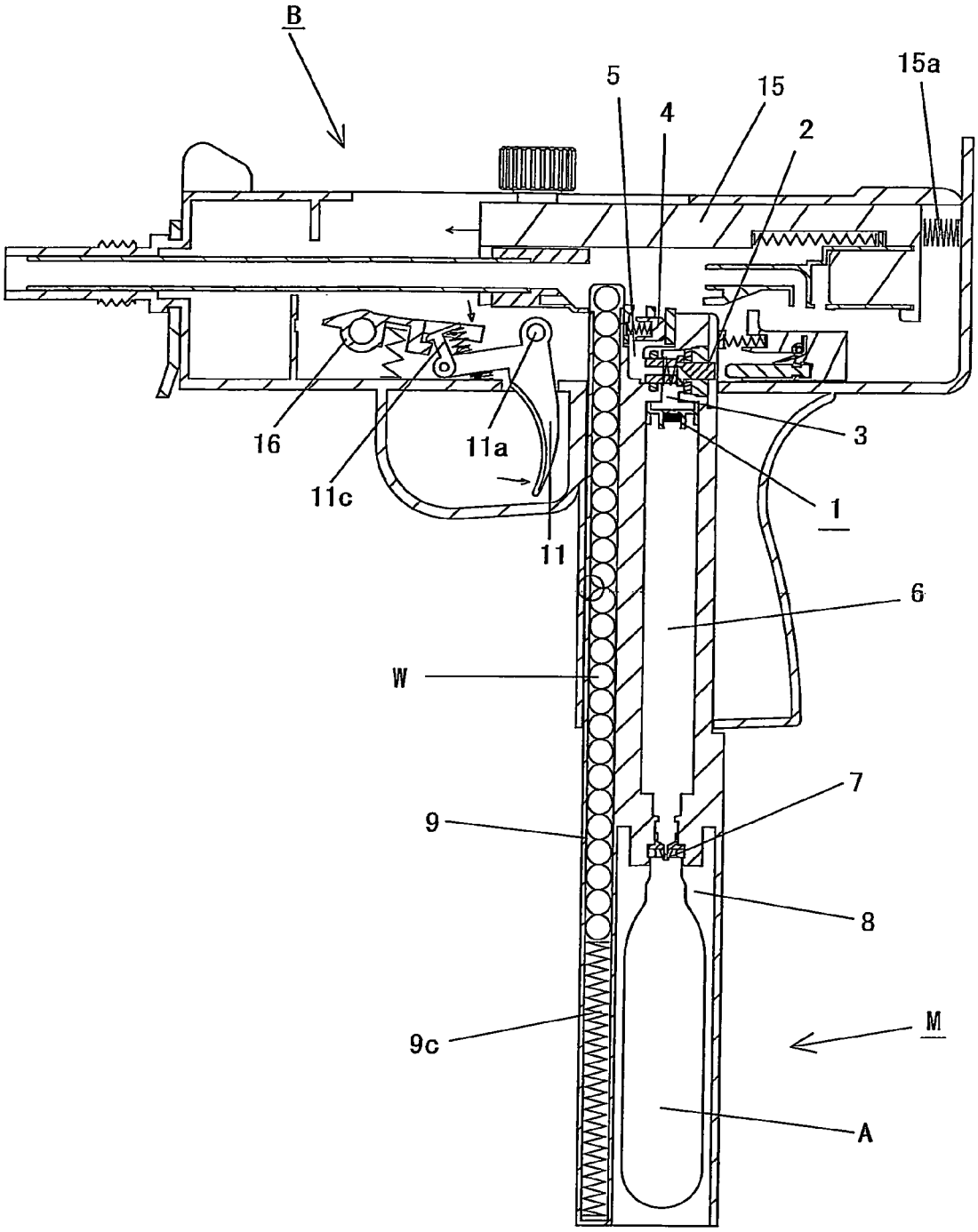
FIG. 3 is a cross sectional explanatory drawing of an air gun for describing an operating state of an air gun and a magazine for an air gun of one embodiment of the present invention.

FIG. 3 shows a state where a user has pulled the trigger 11. If the trigger 11 is pulled, the bolt sear 16 rotates downwards, and contact with the bolt 15 is released, and then the bolt 15 is advanced towards the air gun muzzle side by the bolt return spring 15*a*.

Figure 4:
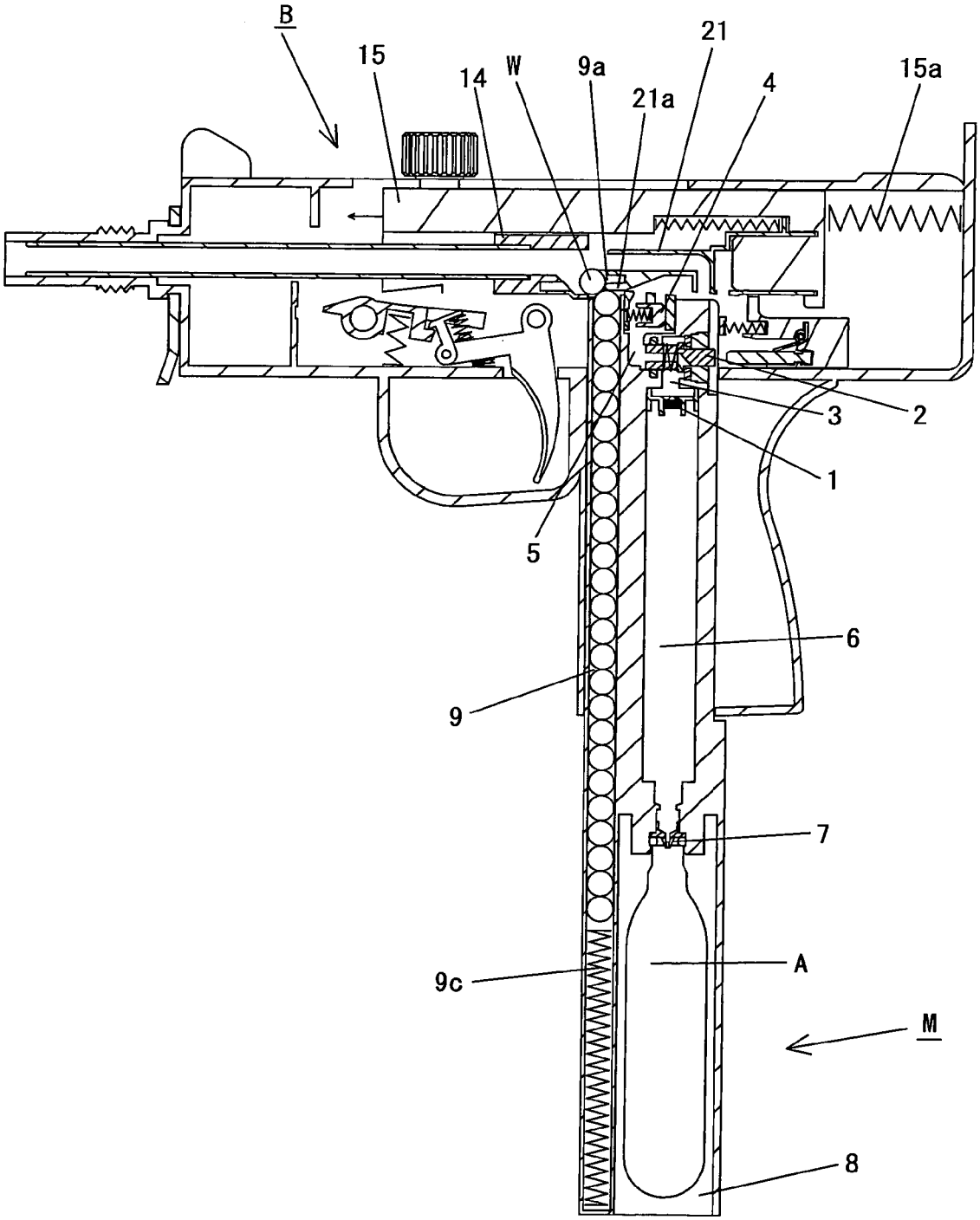
FIG. 4 to FIG. 11 are cross sectional explanatory drawings of an air gun for describing operating states of an air gun and a magazine for an air gun of one embodiment of the present invention.

FIG. 4 shows a state where the under nozzle protrusion 21*a* of the nozzle 21 starts to scoop out a bullet W as a result of the bolt 15 moving to the air gun muzzle side. A bullet W is placed in the chamber 14 from a bullet feed section 9*a* that opens at the uppermost part 9*a* of the loading section 9.

Figure 5:
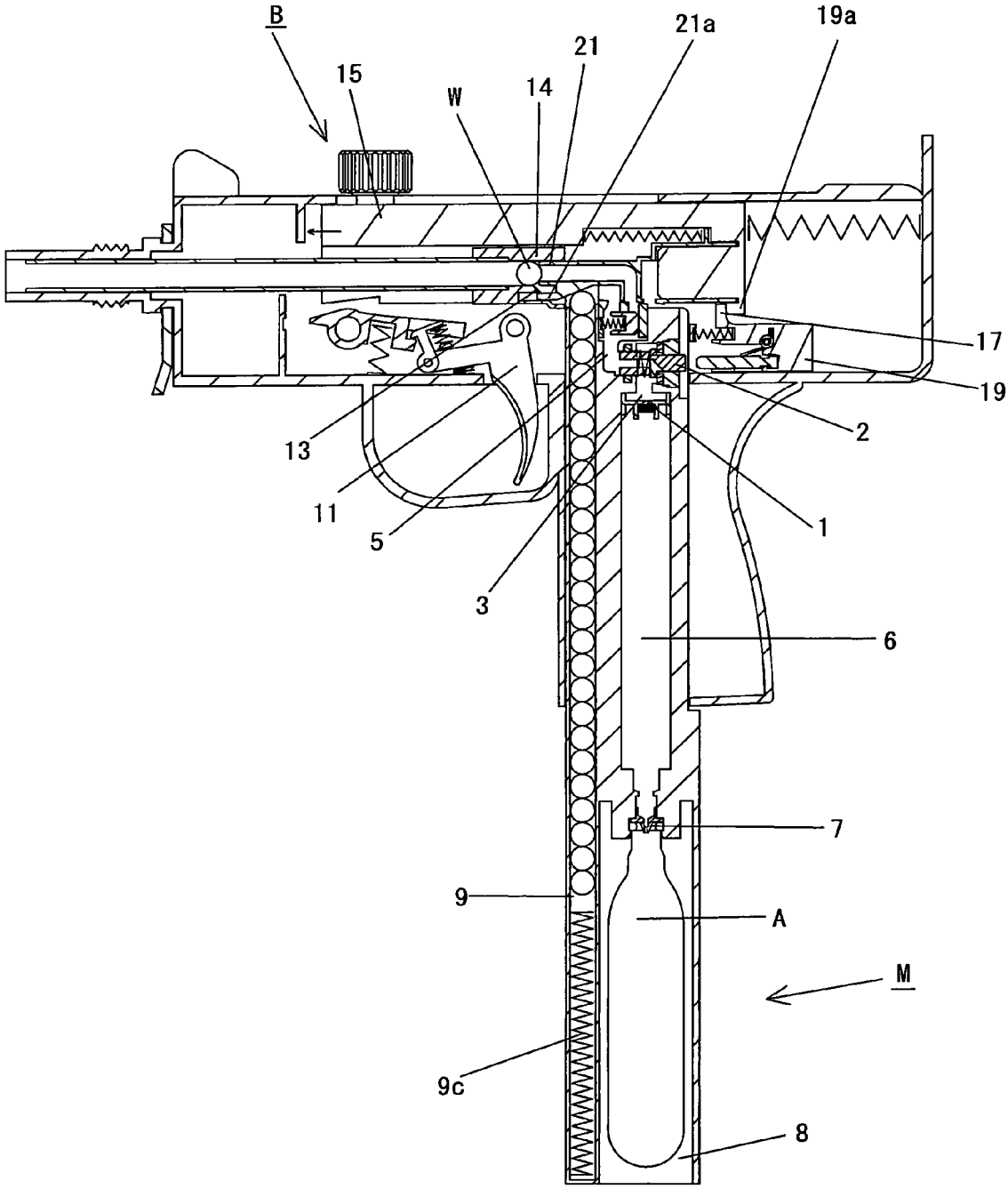

FIG. 5 shows a state where the tip of the nozzle 21 has fed the bullet W to the chamber 14. Simultaneously, the hammer engagement protrusion 19*a* and the bolt engagement protrusion 17 make contact and are pressed to the muzzle side, thus moving the hammer 19 to the muzzle side also.

Figure 6:
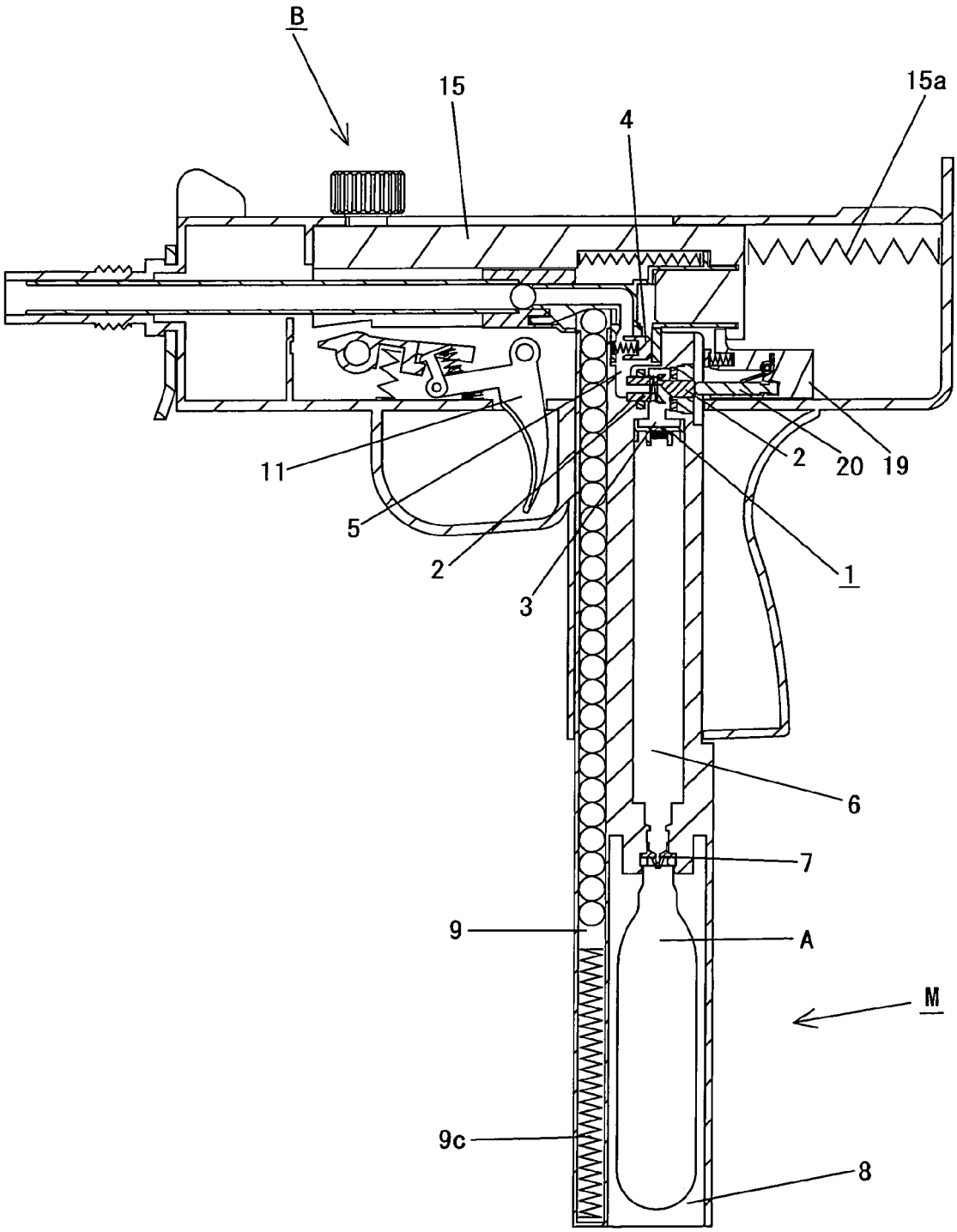

FIG. 6 shows a state where the hit pin 20 is pressed to the muzzle side by movement of the hammer 19 to the muzzle side, and the discharge valve 2 has been pressed by this movement of the hit pin 20. The gas discharge path 2*a* is opened by the movement of the discharge valve 2 to the muzzle side.

Figure 7:
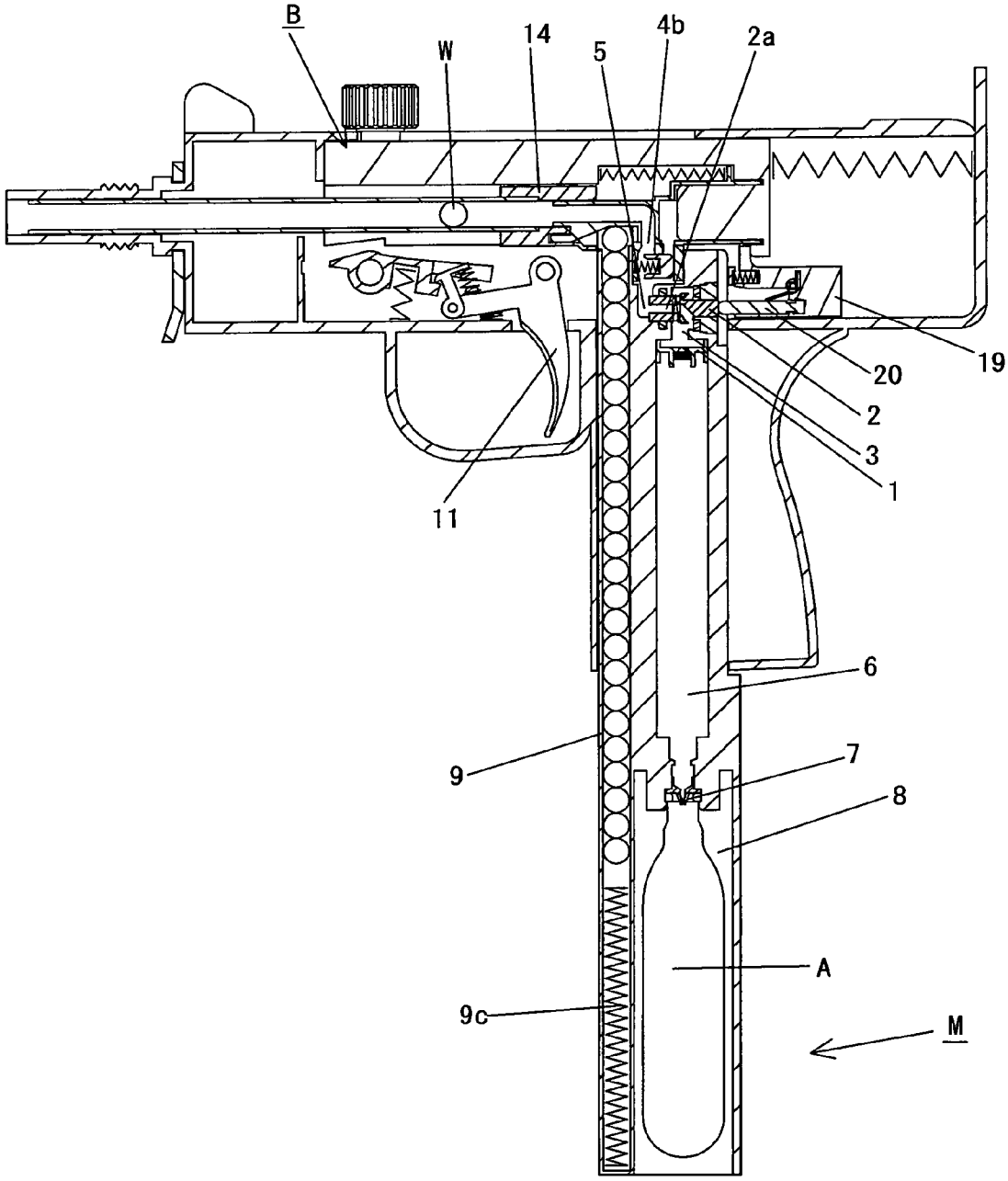

FIG. 7 shows a state where gas pressure from the opening of the gas discharge path 2*a* of FIG. 6 is discharged from the discharge valve chamber 3 to the change valve chamber 5 through the gas discharge path 2*a* of the discharge valve 2, and a bullet W is fired through the chamber 14 by gas pressure passing through the change valve firing side passage 4*b* of the change valve 4.

Figure 8:
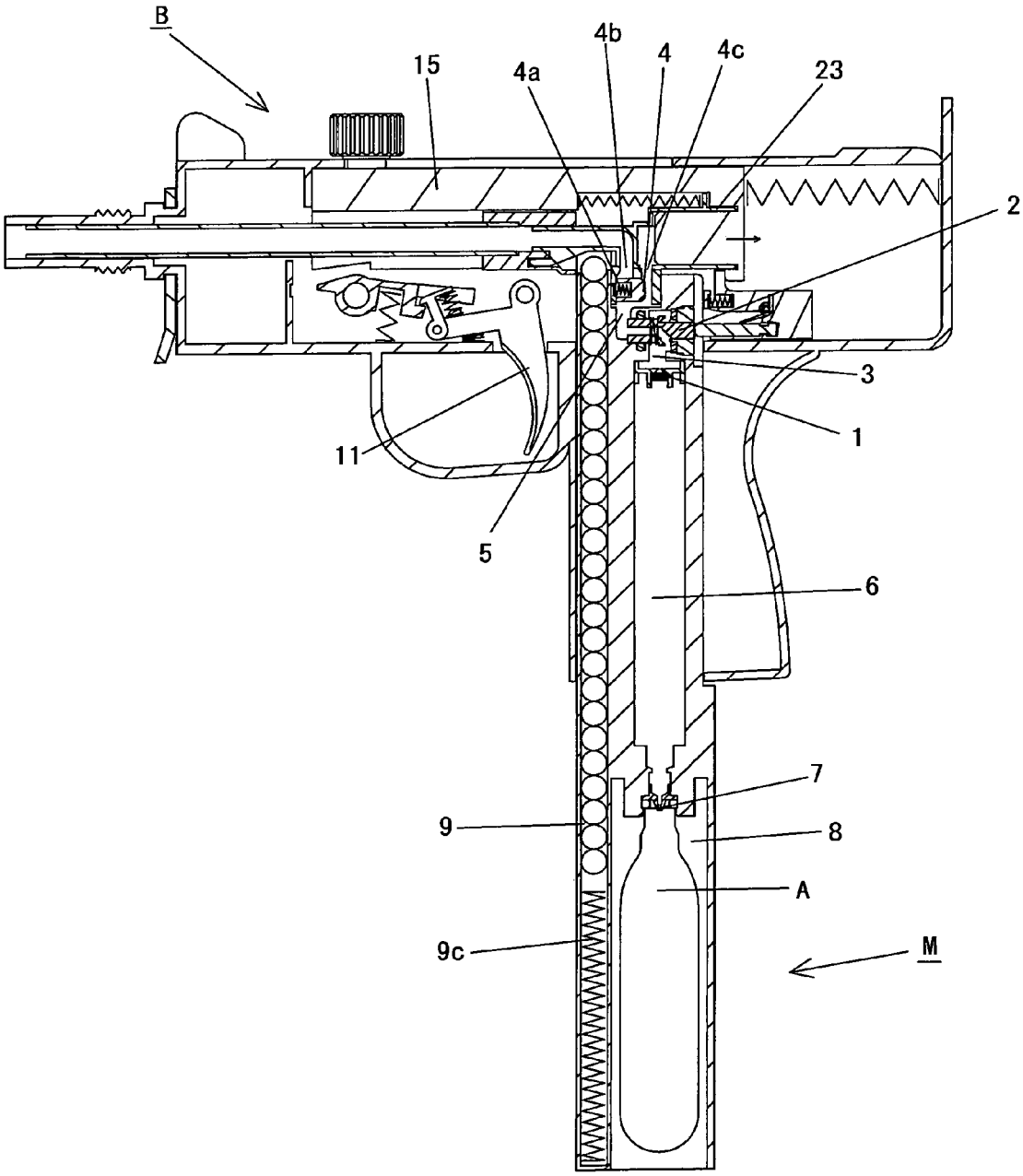

The change valve 4 is normally urged towards the rear of the gun by the change valve spring 4*a*, so the change valve firing side passage 4*b* is open, and the change valve blowback side passage 4*c* is closed. As shown in FIG. 8, in a state where gas passes through the change valve firing side passage 4*b* at high speed, the change valve firing side passage 4*b* becomes negative pressure, and as a result of that the change valve 4 moves to the muzzle side against the urging force of the change valve spring 4*a*, to close the change valve firing side passage 4*b* and open the change valve blowback side passage 4*c*. The bolt 15 starts to retract to the rear due to the gas pressure that has passed through the change valve blowback side passage 4*c*.

Figure 9:
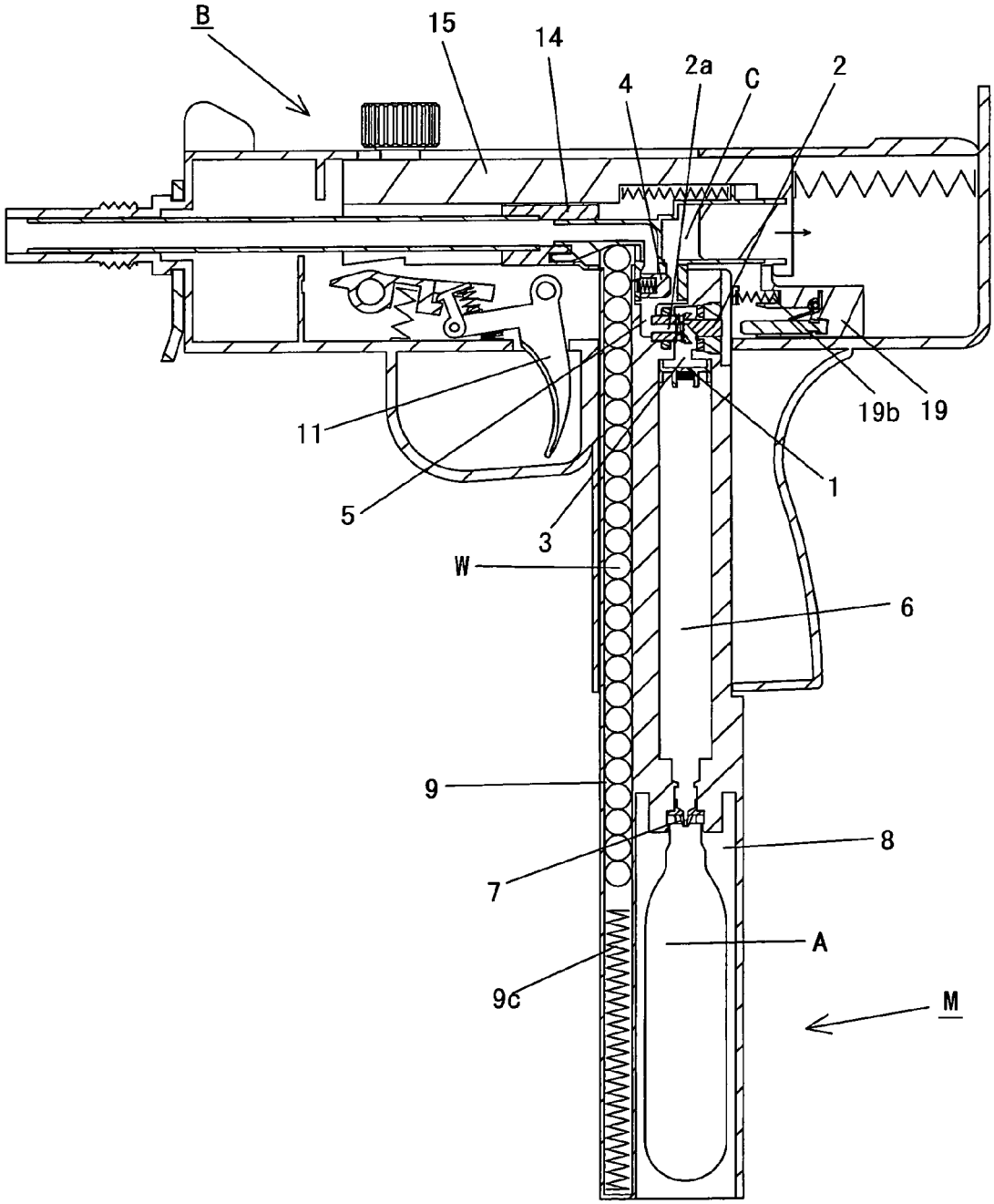

FIG. 9 shows a state where the hammer return spring 19*b* acts due to retraction of the bolt 15 to move the hammer 19 back. Due to retraction of the hammer 19, the hit pin 20 that was pressed to the muzzle side also retracts. The nozzle cylinder 22 is still stopped, and gas continues to enter the hollow C.

Figure 10:
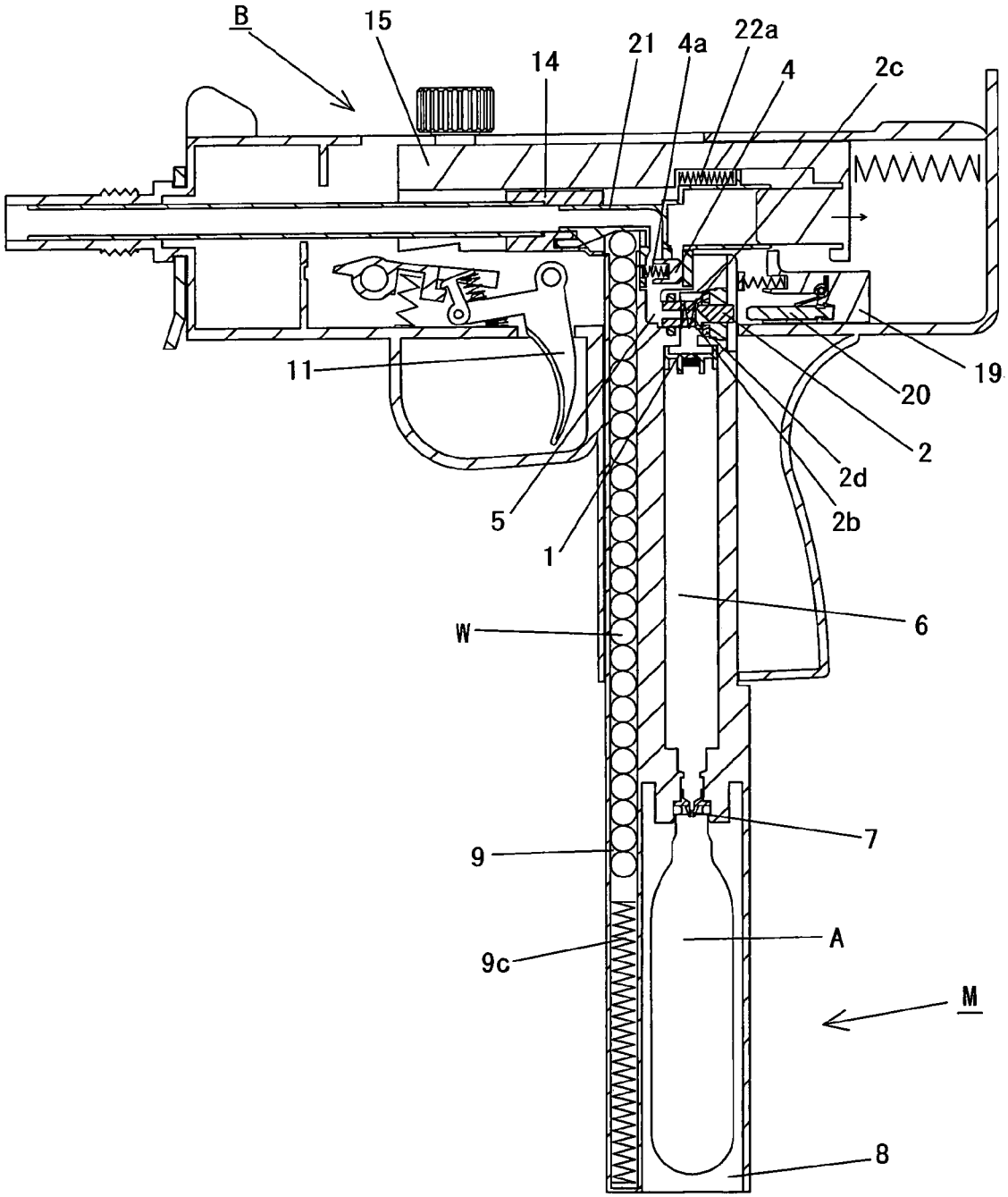

FIG. 10 shows a state where the discharge valve 2 is moved backwards by the urging force of the discharge valve spring 2*c*, due to retraction of the hit pin 20, to close off the gas discharge path 2*a*. Because of the closing of the gas discharge path 2*a*, gas is no longer supplied to the change valve chamber 5, which means that the change valve 4 is urged by the change valve spring 4*a* to the rear of the air gun, the change valve firing side passage 4*b* opens, and the change valve blowback side passage 4*c* is closed. In FIG. 10, the bolt 15 continues to retract strongly.

Figure 11:
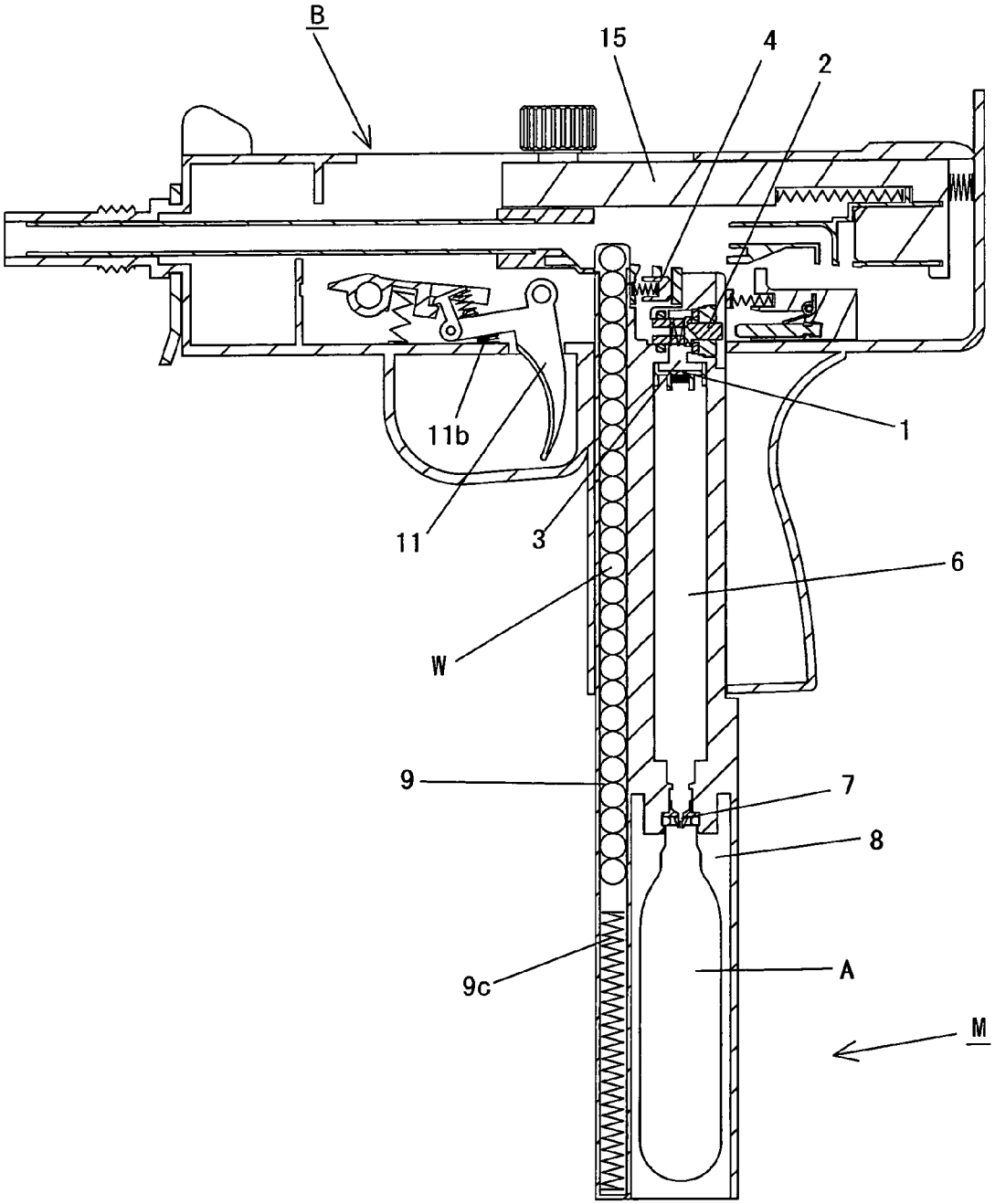

FIG. 11 shows a state where the bolt 15 has retracted to the rearmost section where movement is possible. If the user releases the trigger 11 in this state, the trigger is returned to the position shown in FIG. 2 by the trigger spring 11*b*. If the user pulls the trigger 11 in this state, the states of FIG. 3 to FIG. 11 are sequentially repeated until there is no longer any gas in the gas canister A (full auto).

Figure 12:
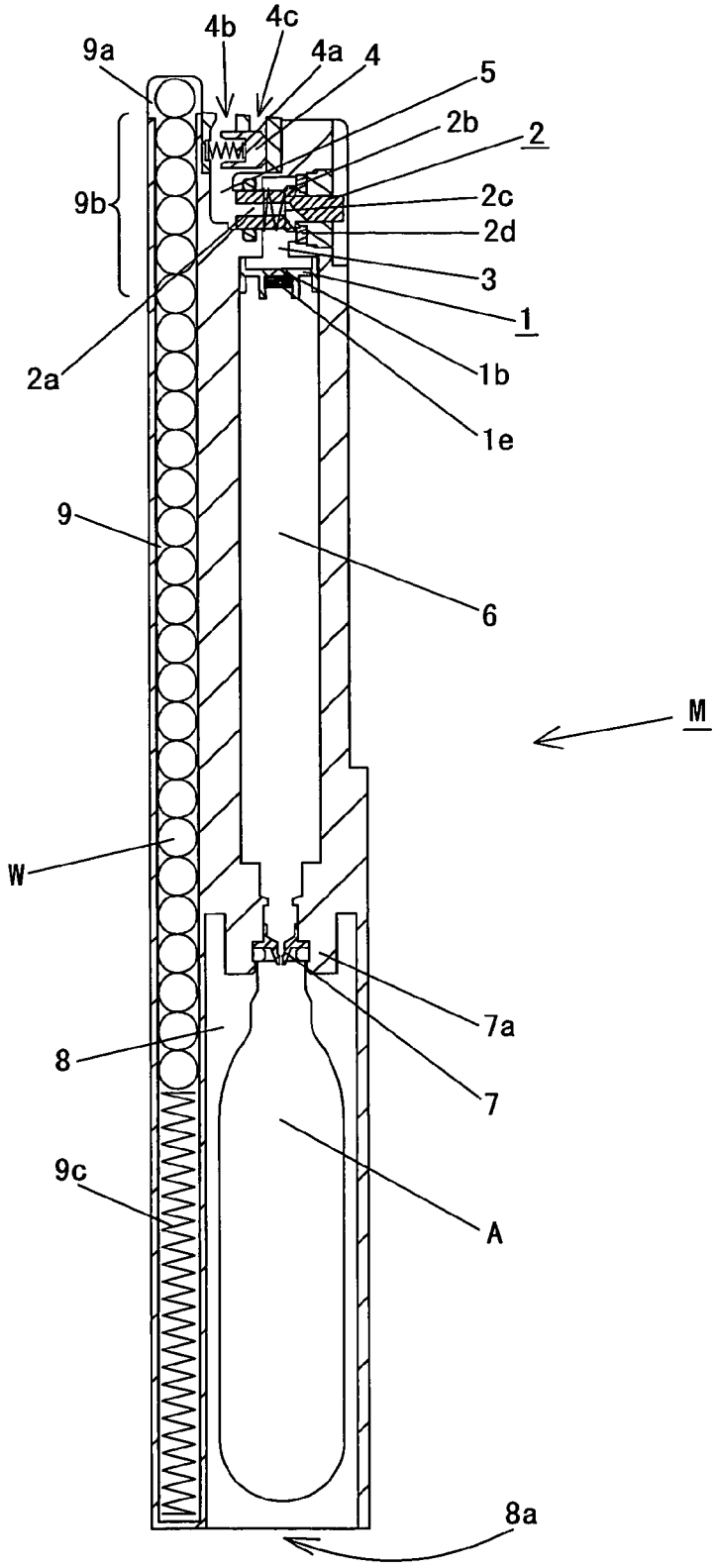
FIG. 12 is a cross sectional explanatory drawing showing the whole of a magazine for air gun that is one embodiment of the present invention.
Figure 20:
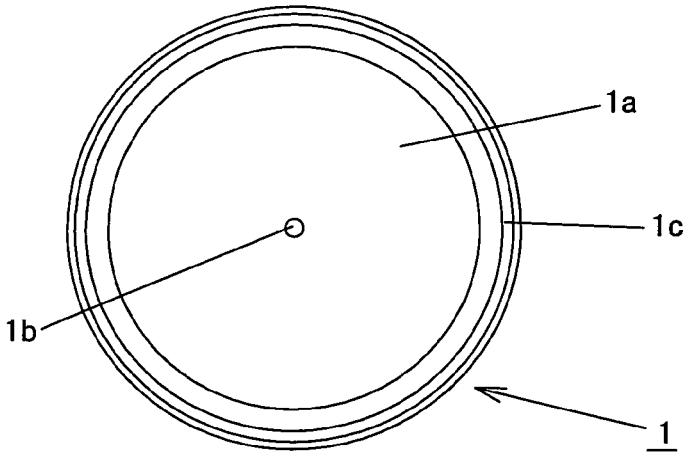
FIG. 20 is a plan view of the partition wall of the invention.
Figure 21:
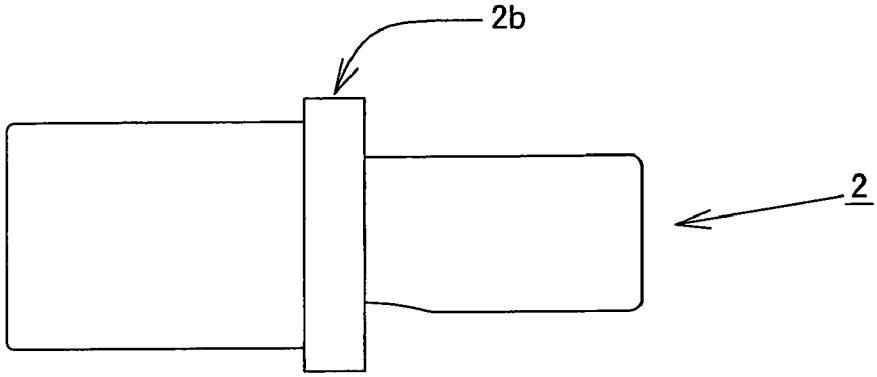
FIG. 21 is a front view of a discharge valve that is one embodiment of this invention.
Figure 22:
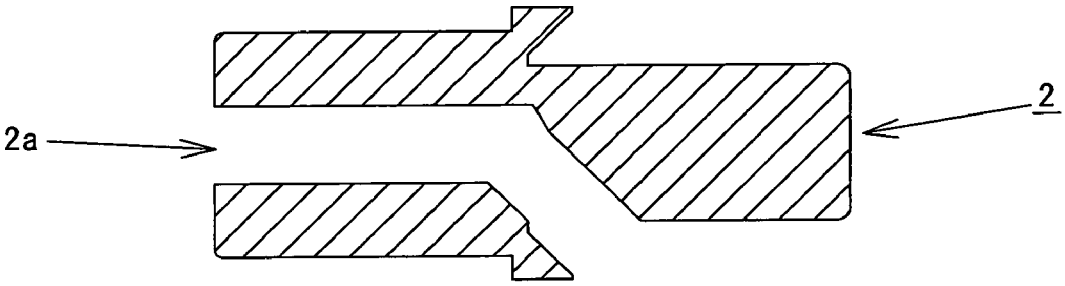
FIG. 22 is a front cross sectional view of the discharge valve of the invention.
Figure 23:
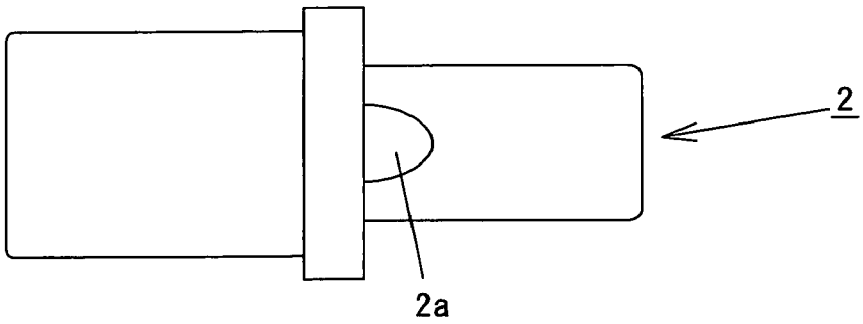
FIG. 23 is a bottom view of the discharge valve of the invention.
Figure 24:
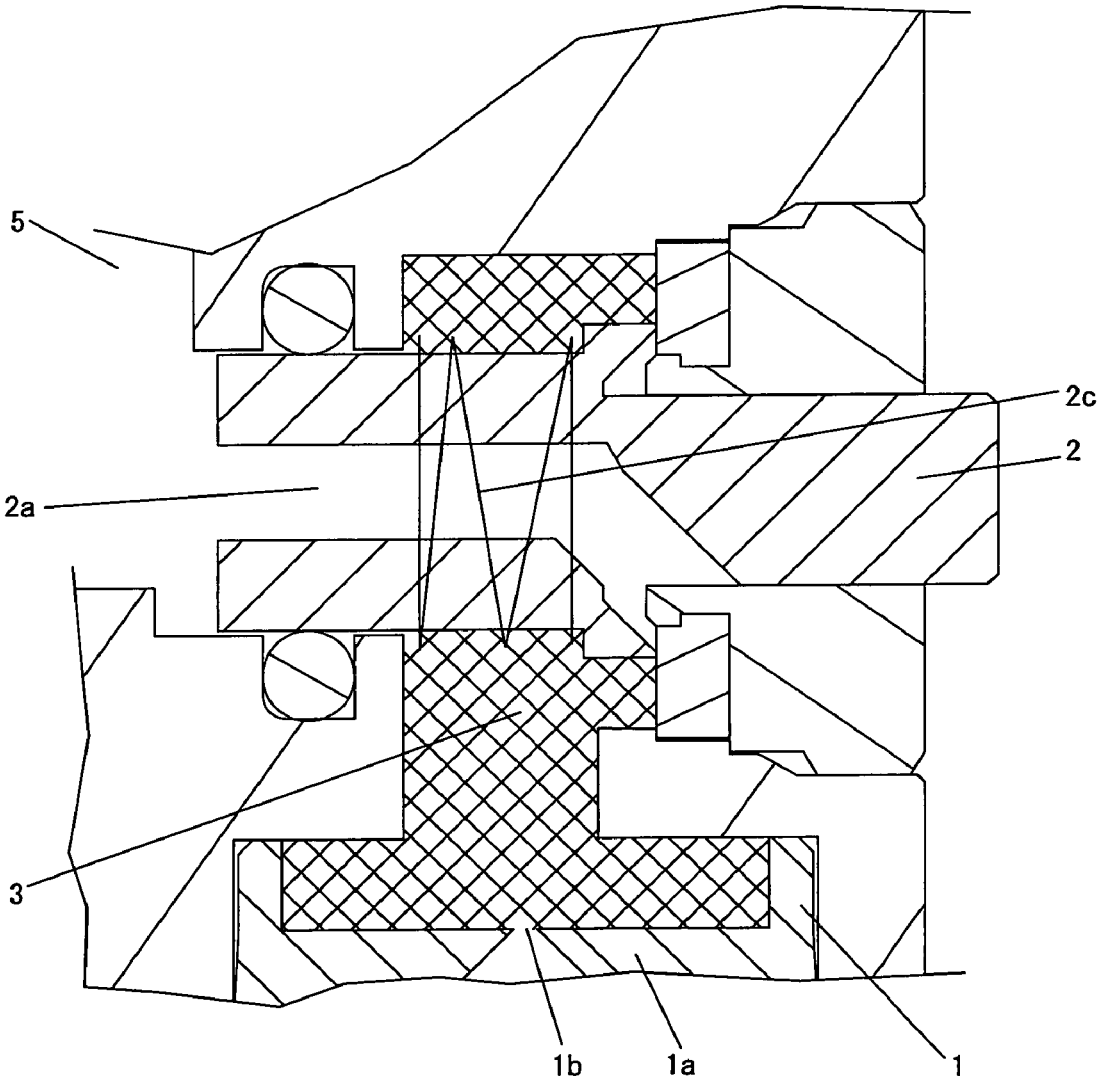
FIG. 24 is a cross-sectional explanatory drawing of a discharge valve chamber that is one embodiment of this invention.

Next, description of the magazine M of the air gun of one embodiment of the invention will be described based on FIG. 12 which is a cross sectional explanatory drawing showing the whole of the magazine M, FIG. 13 to FIG. 17 which are enlarged cross sectional explanatory drawings of essential parts showing operation of essential parts, FIG. 18 to FIG. 20 which showing a partition wall, FIG. 21 to FIG. 23 showing a discharge valve, and FIG. 24 showing a discharge valve chamber.

The magazine M has a loading section 9, capable of being loaded with bullets W and provided with a magazine spring 9*c* at a lower part and a bullet feed opening 9*a* at an upper part, a gas canister housing section 8 capable of holding a gas canister A, a piercing assembly 7 meshing with a gas exhaust nozzle of the gas canister A, a puncture section 7*a* at a peripheral part of the piercing assembly 7, a vaporization chamber 6, a partition wall 1 having a microscopic hole 1*b*, a filter 1*e* provided on a filter mounting section 1*d* so as to cover the microscopic hole 1*b*, a discharge valve 2 having a gas discharge path 2*a*, a discharge valve chamber 3, a change valve 4 and a change valve chamber 5.

Figure 18:
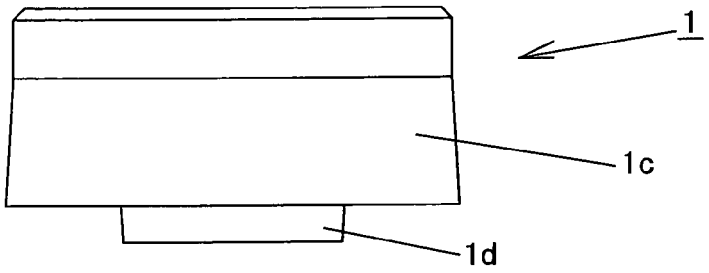
FIG. 18 is a front view of a partition wall that is one embodiment of this invention.
Figure 19:
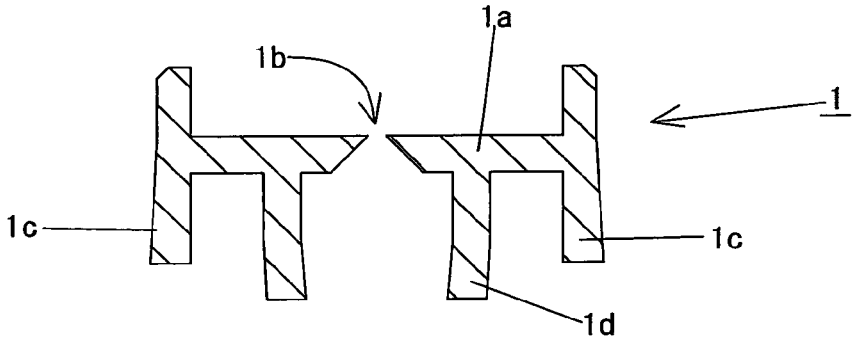
FIG. 19 is a front cross sectional view of the partition wall of the invention.

The partition wall 1 has a microscopic hole 1*b* formed in the center of a circular plate 1*a*, as shown in FIG. 18 to FIG. 20, and is provided between the piercing assembly 7 and the discharge valve 2. The partition wall 1 is provided fitting into an inner wall of the vaporization chamber 6 using the peripheral wall 1*c* formed at the periphery of the circular plate 1*a* provided at an upper end section of the vaporization chamber 6. 1*d* is a filter mounting part, and is provided with a filter 1*e*, but it is also possible to not provide the filter 1*e*. The microscopic hole 1*b* of the partition wall 1 is formed having an opening area that is wide at the volatilization chamber 6 side, which is upstream of the gas, and narrow at the discharge chamber 3 side, and is an inverted cone shape, for example, and with this embodiment the narrow surface area of the discharge chamber 3 side is 0.2 $mm^2$ or less.

The discharge valve 2 is formed with a gas discharge path 2*a* passing though the inside, running longitudinally downwards from a mid point in the longitudinal direction, as shown in FIG. 21 to FIG. 23. 2*b* is a valve large diameter section, FIG. 24 shows the discharge valve chamber 3, with a mesh pattern, in a state where the gas discharge path 2*a* of the discharge valve 2 is closed off. The discharge valve chamber 3 is a space formed between the partition wall 1, in a state where the discharge valve 2 is urged to the rear of the air gun by the urging force of the discharge valve spring 2*c* and the gas discharge path 2*a* is closed. In this state, the total volume of parts of the discharge valve chamber 3 shown by the mesh pattern is 580 $mm^3$ or less in this embodiment, but it can be 580 $mm^3$ or greater.

Figure 13:
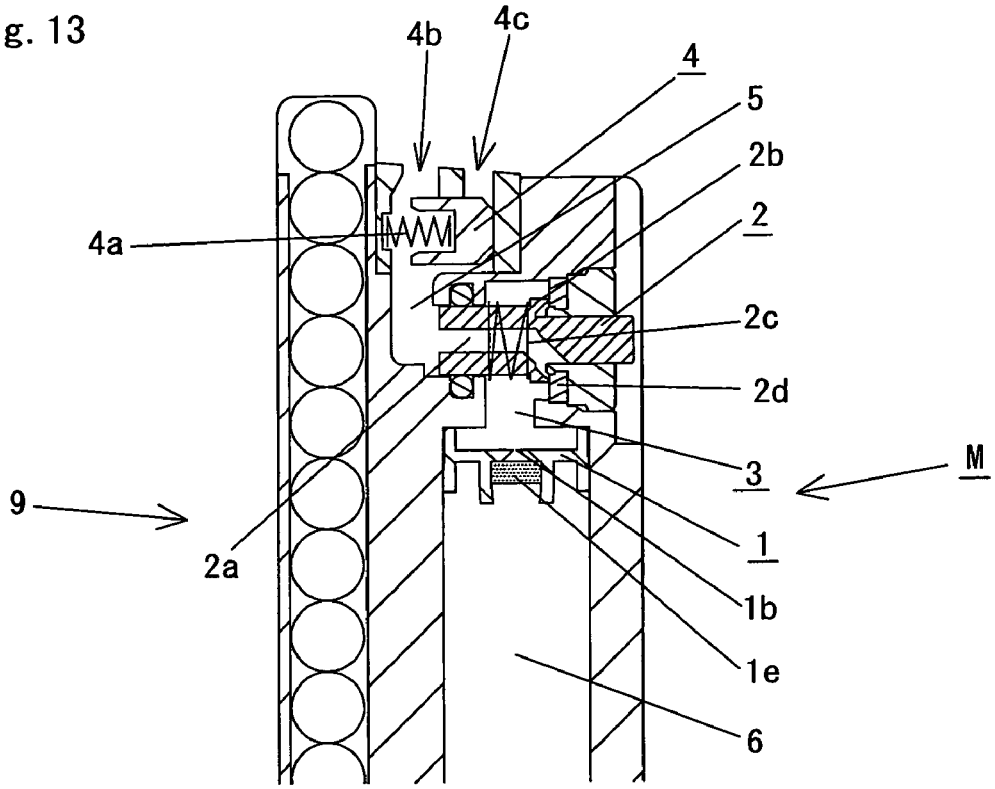
FIGS. 13 to 17 are magnified views of essential parts showing the actions of essential parts of the magazine for the air gun of one embodiment of the present invention.

Next, description will be given based on FIG. 13 to FIG. 17, which are enlarged cross sectional drawings of essential parts, showing operation of essential parts of this invention. FIG. 13 is a drawing corresponding to the state of the air gun that was described in FIG. 2 to FIG. 5. In this state, the discharge valve 2 is urged to the rear of the air gun by the urging force of the discharge valve spring 2*c*, resulting in a state where the gas discharge path 2*a* is closed off. As a result, there is no flow of compressed gas.

Figure 14:
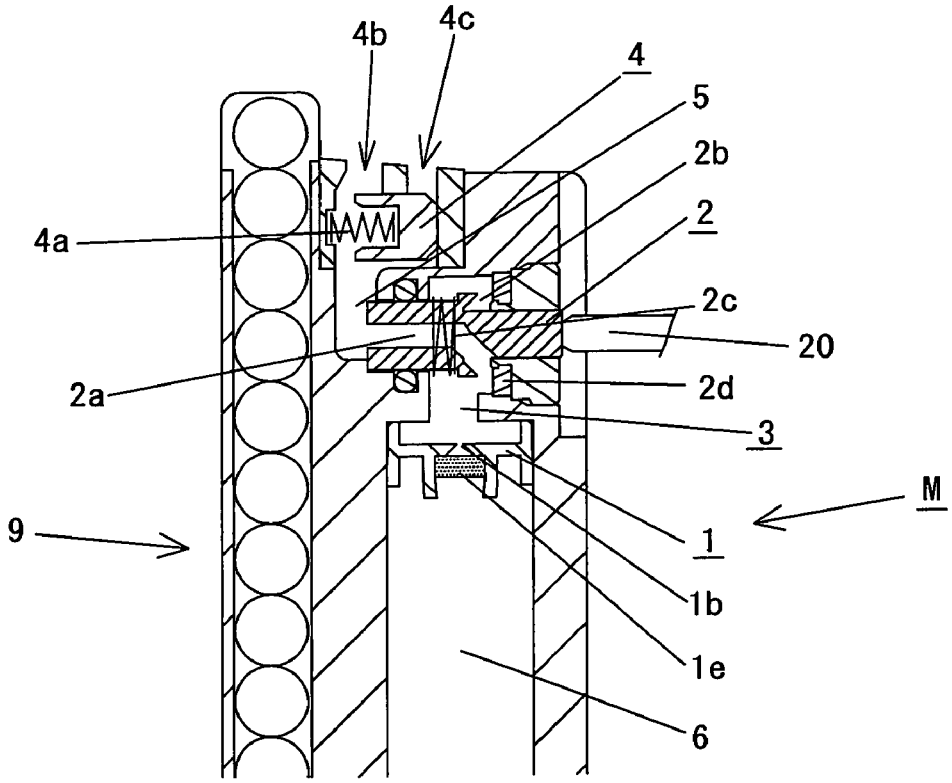

FIG. 14 is a drawing corresponding to the state of the air gun that was described in FIG. 6. The hit pin 20 is pressed to the muzzle side by movement of the hammer 19 to the muzzle side, and the discharge valve 2 is moved to the muzzle side by this movement of the hit pin 20. The gas discharge path 2*a* is opened by this movement of the discharge valve 2 to the muzzle side. The open area of this gas discharge path 2*a* is larger than the open area of the microscopic hole section 1*b* of the partition wall 1 (0.2 $mm^2$), and in this embodiment is about 3.1 $mm^2$. Accordingly, with this embodiment the opening area of the gas discharge path 2*a* is about sixteen times the opening area of the microscopic hole section 1*b*. Numerical values of the opening area of the gas discharge path 2*a* and the opening area of the microscopic hole section 1*b* vary depending on conditions such as the material of respective members of the air gun, blowback strength, range of firing speeds for bullets to be fired, etc., and so the above numerical values are examples. Accordingly, it is also possible for the opening area of the gas discharge path 2*a* to be larger than the opening area of the microscopic hole section 1*b*.

Figure 15:
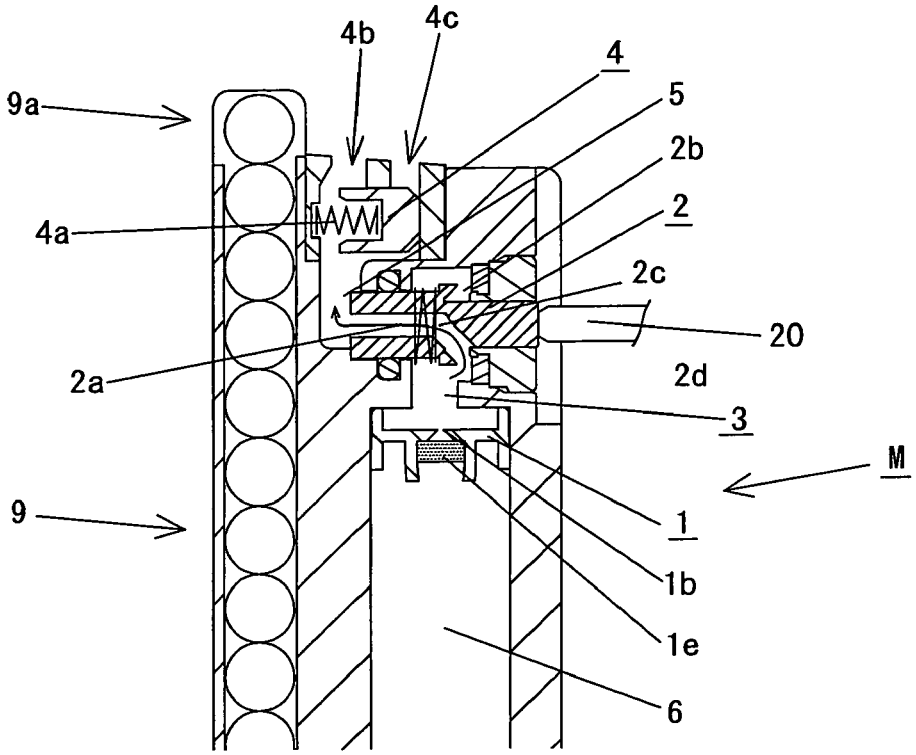

FIG. 15 is a drawing corresponding to the state of the air gun that was described in FIG. 7. Due to opening of the gas discharge path 2*a*, compressed gas flows from the gas canister A through the piercing assembly 7 and the vaporization chamber 6, and from the microscopic hole section 1*b* of the partition wall 1 into the discharge valve chamber 3, and is discharged from the discharge valve chamber 3 through the opened gas discharge passage 2*a* to the change valve chamber 5. Further, compressed gas passes through the change valve firing side passage 4*b* of the change valve 4 provided in the change valve chamber 5, and fires a bullet that is in the chamber 14.

At this time, a volume of compressed gas per unit time that flows into the discharge valve chamber 3 from the microscopic hole section 1*b* of the partition wall 1 is smaller than the gas volume per unit time that flows out from the discharge valve chamber 3 to the change valve chamber due to the opening of the gas discharge path 2*a* of the discharge valve 2, because the opening area of the microscopic hole section 1*b* is smaller that the opening area of the gas discharge path 2*a*. Accordingly, the gas pressure of the discharge valve chamber 5 is lower than the gas pressure of the vaporization chamber 6.

Figure 16:
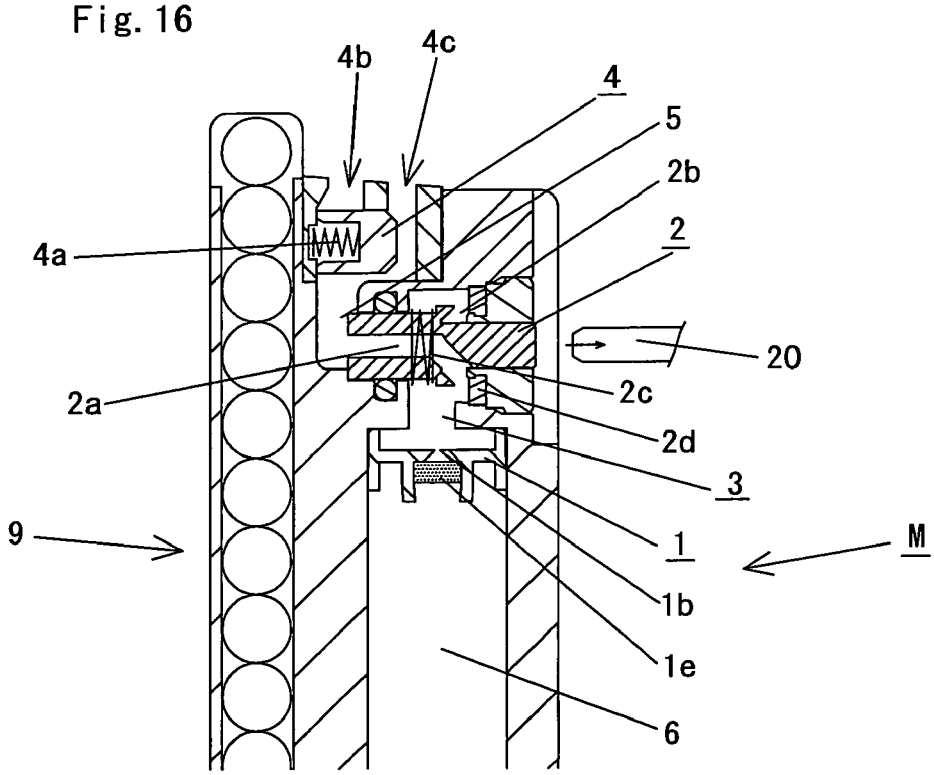

FIG. 16 is a drawing corresponding to the state of the air gun that was described in FIG. 9. As a result of retraction of the hammer 19, the hit pin 20 is also retracted.

Figure 17:
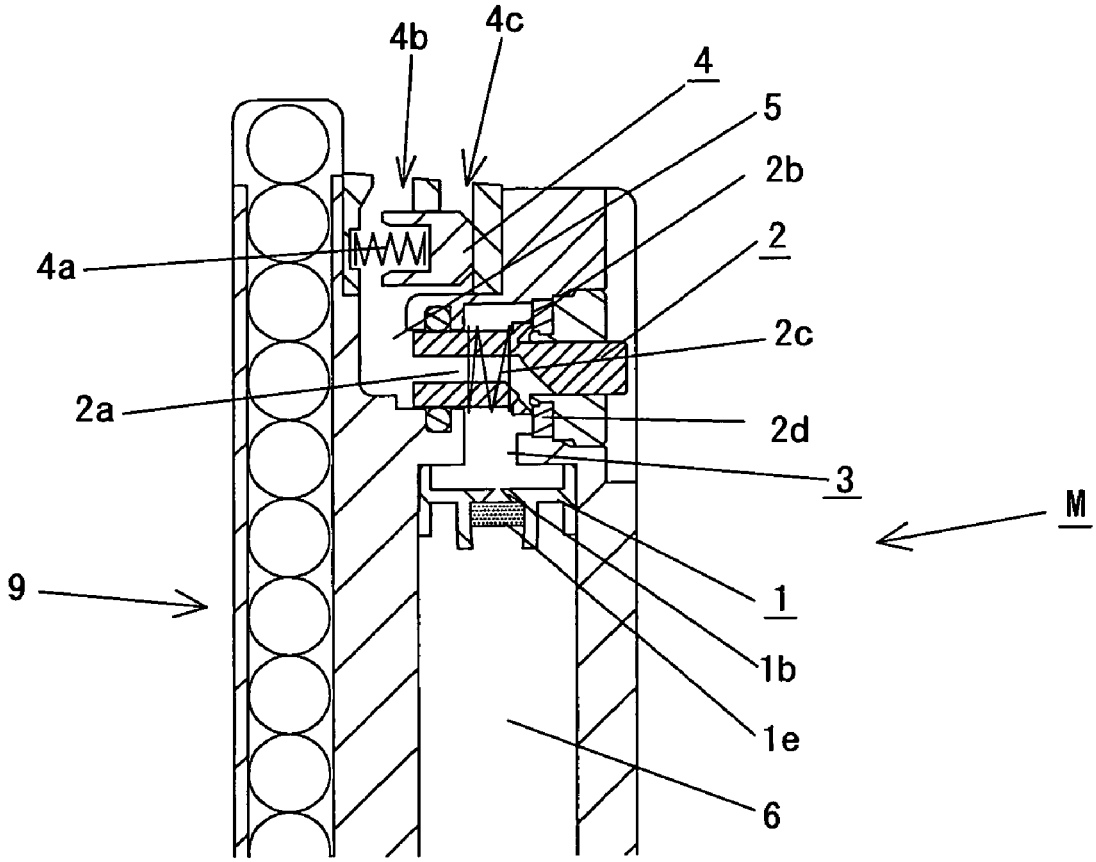

FIG. 17 is a drawing corresponding to the state of the air gun that was described in FIG. 10 and FIG. 11.

The discharge valve 2 is moved backwards by the urging force of the discharge valve spring 2*c*, due to retraction of the hit pin 20, to close off the gas discharge path 2*a*. Because of the closing of the gas discharge path 2*a*, gas is no longer supplied to the change valve chamber 5, which means that the change valve 4 is urged by the change valve spring 4*a* to the rear of the air gun, the change valve firing side passage 4*b* opens, and the change valve blowback side passage 4*c* is closed.

Figure 25:
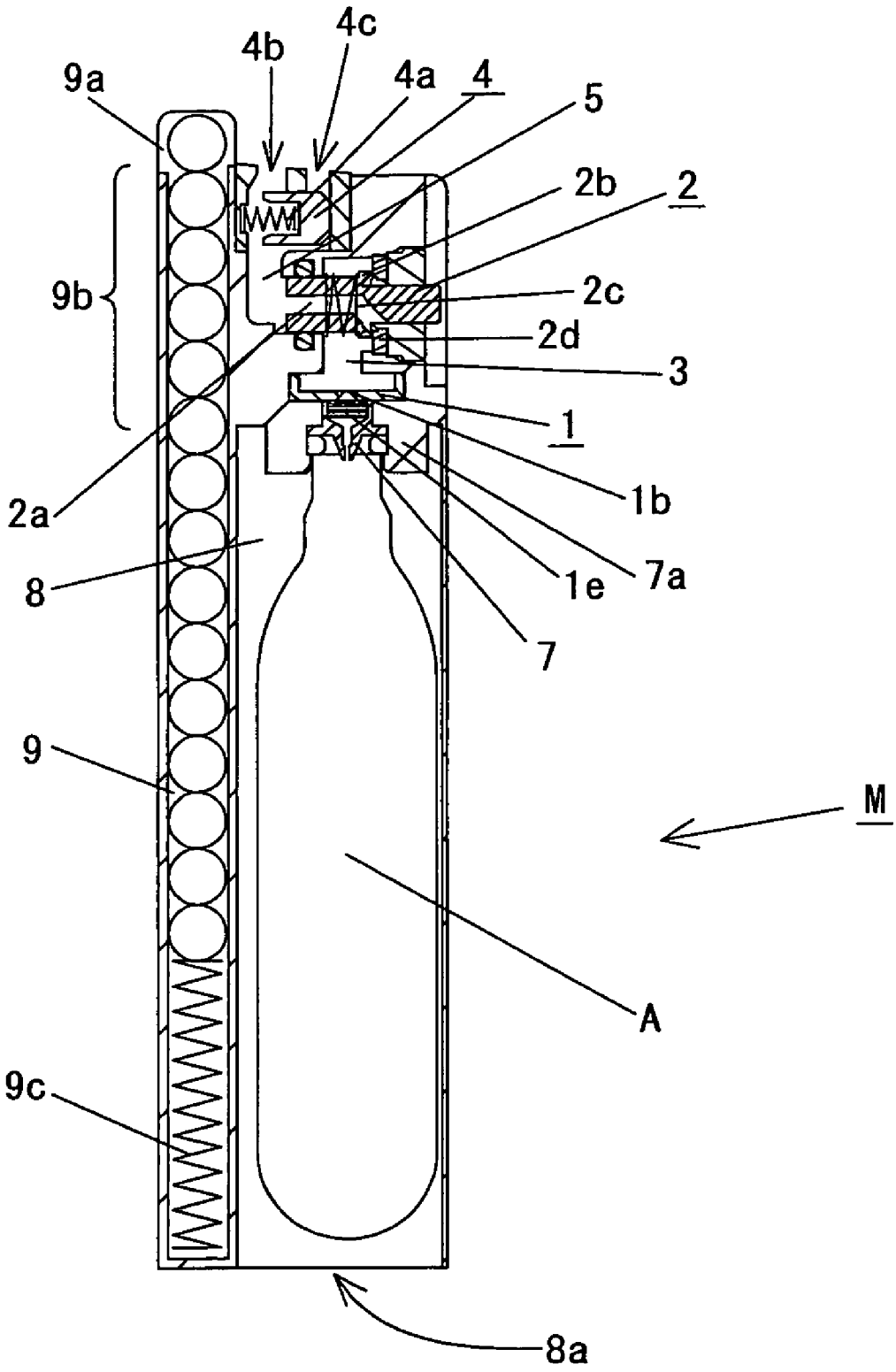
FIG. 25 is a cross sectional explanatory drawing showing the whole of a magazine for an air gun that is not provided with a vaporization chamber, being another embodiment of this invention.
Figure 26:
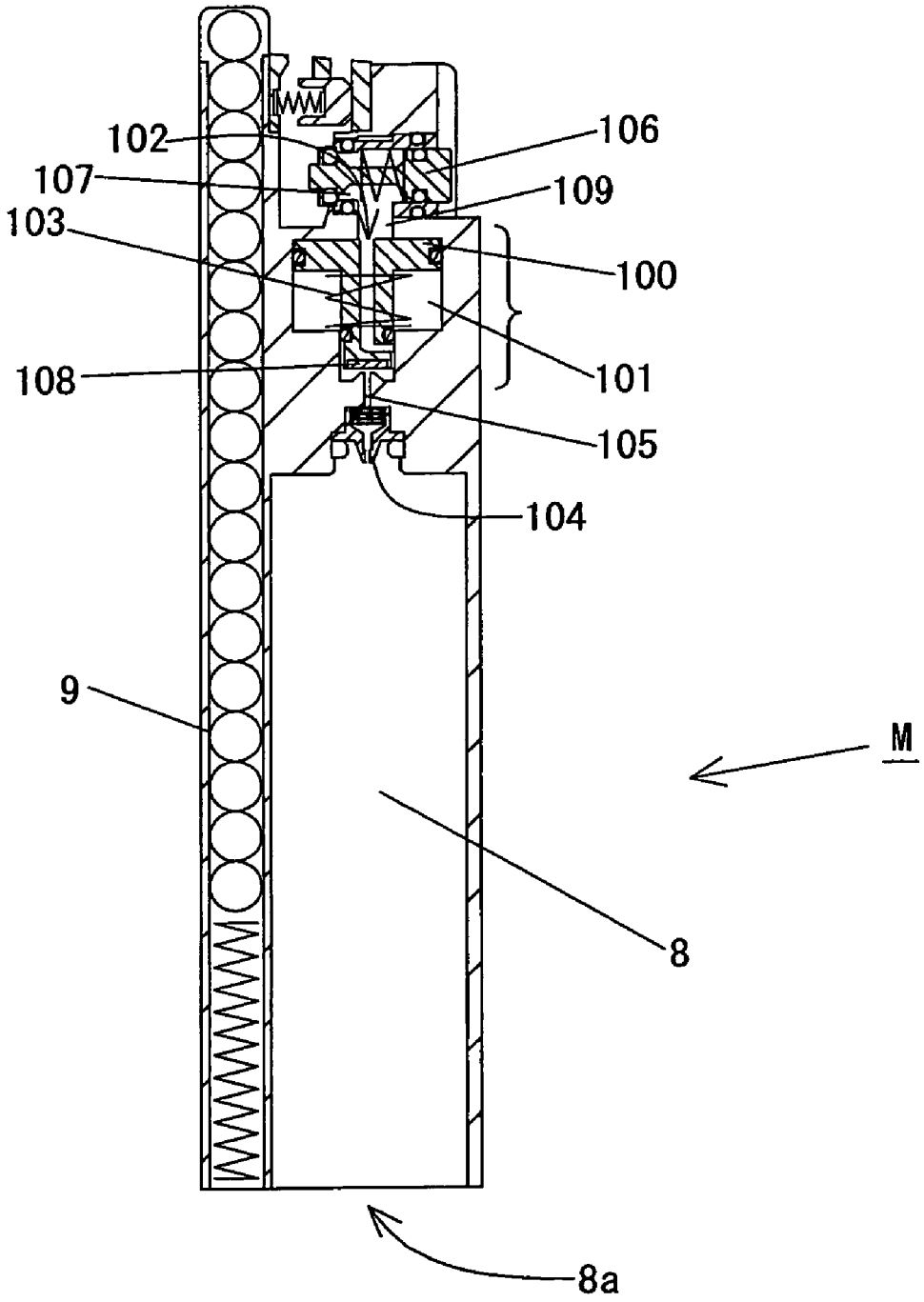
FIG. 26 is a cross sectional explanatory drawings of a magazine for an air gun that performs decompression using a regulator, and is related art.
Figure 27:
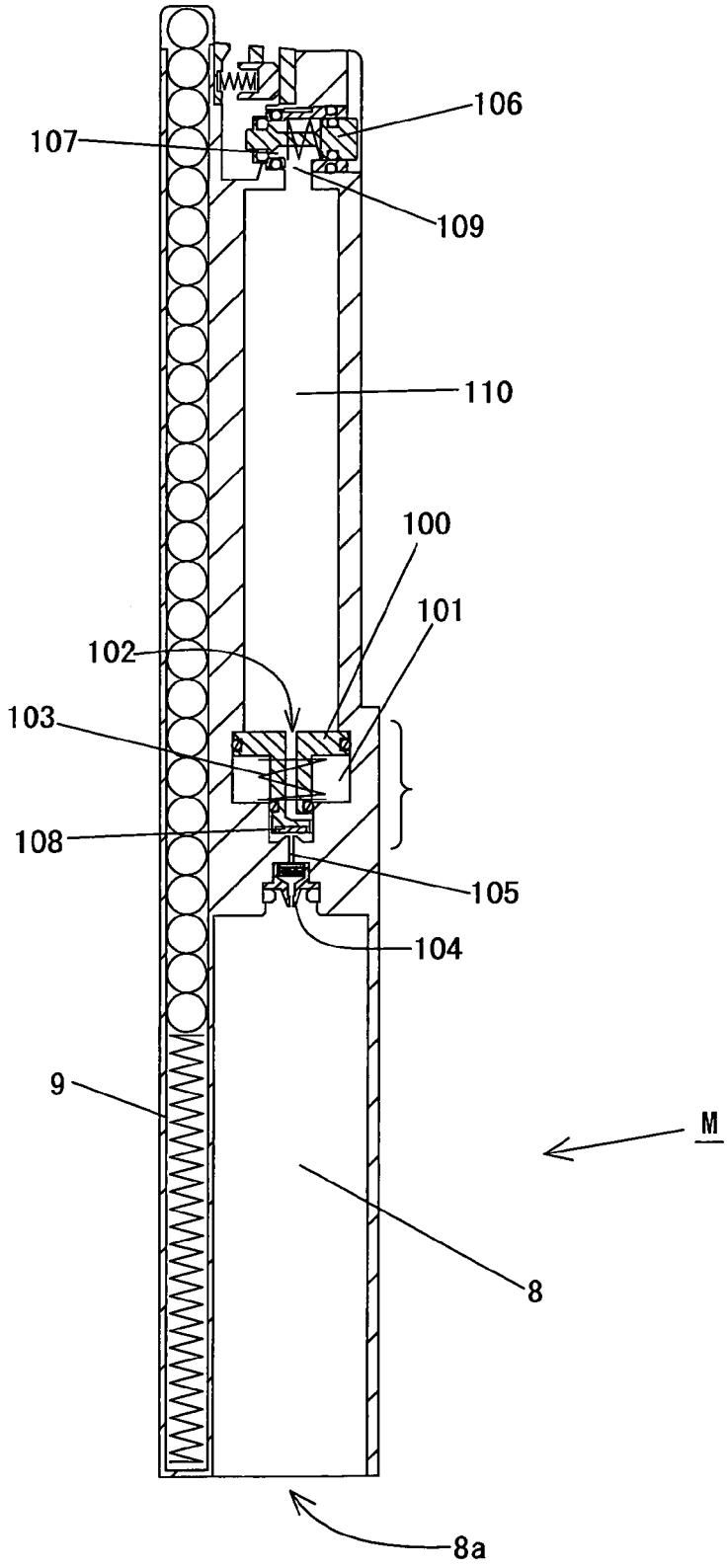
FIG. 27 is a cross sectional explanatory drawings of a magazine for an air gun that has a vaporization chamber and performs decompression using a regulator, and is related art.

FIG. 25 shows a magazine M of a style loaded with comparatively few bullets W in a loading section 9, and apart from the fact that the vaporization chamber 6 is not provided has similar structure and operation as the above-described magazine M.

INDUSTRIAL APPLICABILITY

This invention is used in an air gun for performing firing of bullets using compressed gas, and in an air gun that performs firing of bullets and blowback using compressed gas, and can reduce the firing speed of a bullet with a simple structure.

What is claimed is:

1. An air gun for firing bullets using compressed gas, the air gun comprising:

a hit pin movable to and between a retracted position and a hit position, the hit pin being resiliently biased towards the retracted position;

a piercing assembly capable of fitting a gas canister, being a compressed gas source;

a discharge valve, having a gas discharge path, capable of either discharging compressed gas from the gas canister to a chamber or stopping discharge of compressed gas to the chamber; and a partition wall provided between the piercing assembly and the discharge valve, and forming a microscopic hole section, wherein:

the discharge valve closes off the gas discharge path due to an urging force of a discharge valve spring, so that a discharge valve chamber is formed between the partition wall and the discharge valve, the discharge valve discharges compressed gas from the gas discharge path by opening the gas discharge path as a result of a pressing force on the discharge valve due to the hit pin moving from the retracted position to the hit position to hit the discharge valve, and a gas volume per unit time that flows from the microscopic hole section of the partition wall into the discharge valve chamber is lower than a gas volume per unit time that flows out from the discharge valve chamber as a result of opening the gas discharge path of the discharge valve.

2. An air gun for firing bullets using compressed gas, the air gun comprising:

a hit pin movable to and between a retracted position and a hit position, the hit pin being resiliently biased towards the retracted position;

a piercing assembly capable of fitting a gas canister, being a compressed gas source;

a discharge valve, having a gas discharge path, capable of either discharging compressed gas from the gas canister to a chamber or stopping discharge of compressed gas to the chamber; and a partition wall provided between the piercing assembly and the discharge valve, and forming a microscopic hole section, wherein:

the discharge valve closes off the gas discharge path due to an urging force of a discharge valve spring, so that a discharge valve chamber is formed between the partition wall and the discharge valve, the discharge valve discharges compressed gas from the gas discharge path by opening the gas discharge path as a result of a pressing force on the discharge valve due to the hit pin moving from the retracted position to the hit position to hit the discharge valve, and an opening area of the microscopic hole section of the partition wall is smaller than the gas discharge path opening area in a state where the gas discharge path of the discharge valve is open.

3. A magazine for an air gun and capable of being fitted into the air gun for firing bullets using compressed gas, the air gun having a hit pin movable to and between a retracted position and a hit position, the hit pin being resiliently biased towards the retracted position, the magazine comprising:

a magazine body including:

a piercing assembly capable of fitting a gas canister, being a compressed gas source;

a discharge valve, having a gas discharge path, capable of either discharging compressed gas from the gas canister to a chamber or stopping discharge of compressed gas to the chamber; and a partition wall provided between the piercing assembly and the discharge valve, and forming a microscopic hole section, wherein:

the discharge valve closes off the gas discharge path due to an urging force of a discharge valve spring, so that a discharge valve chamber is formed between the partition wall and the discharge valve, the discharge valve discharges compressed gas from the gas discharge path by opening the gas discharge path as a result of a pressing force on the discharge valve due to the hit pin moving from the retracted position to the hit position to hit the discharge valve, and a gas volume per unit time that flows from the microscopic hole section of the partition wall into the discharge valve chamber is lower than a gas volume per unit time that flows out from the discharge valve chamber as a result of opening the gas discharge path of the discharge valve.

4. A magazine for an air gun and capable of being fitted into the air gun for firing bullets using compressed gas, the air gun having a hit pin movable to and between a retracted position and a hit position, the hit pin being resiliently biased towards the retracted position, the magazine comprising:

a magazine body including:

a piercing assembly capable of fitting a gas canister, being a compressed gas source;

a discharge valve, having a gas discharge path, capable of either discharging compressed gas from the gas canister to a chamber or stopping discharge of compressed gas to the chamber; and a partition wall provided between the piercing assembly and the discharge valve, and forming a microscopic hole section, wherein:

the discharge valve closes off the gas discharge path due to an urging force of a discharge valve spring, so that a discharge valve chamber is formed between the partition wall and the discharge valve, and the discharge valve discharges compressed gas from the gas discharge path by opening the gas discharge path as a result of a pressing force on the discharge valve due to the hit pin moving from the retracted position to the hit position to hit the discharge valve, and an opening area of the microscopic hole section of the partition wall is smaller than the gas discharge path opening area in a state where the gas discharge path of the discharge valve is open.

* * * * *